United States Patent [19]

Förster et al.

[11] 4,369,706

[45] Jan. 25, 1983

[54] CONTROL DEVICE FOR REMOTE ADJUSTMENTS OF INK ZONES IN PRINTING PRESSES

[75] Inventors: Karl-Heinz Förster, Dresden; Hans Johne, Radebeul; Helmut Schuck, Coswig; Ludwig Friedrich, Dresden, all of German Democratic Rep.

[73] Assignee: VEB Kombinat Polygraph "Werner Lamberz" Leipzig, Leipzig, German Democratic Rep.

[21] Appl. No.: 252,126

[22] Filed: Apr. 8, 1981

[30] Foreign Application Priority Data

Apr. 10, 1980 [DD] German Democratic Rep. ... 220346

[51] Int. Cl.[3] ..... B41F 31/04

[52] U.S. Cl. ..... 101/365

[58] Field of Search ..... 101/365, 363, 350, 349, 101/148, 206, 207, 208, 209, 210, 248; 340/163

[56] References Cited

U.S. PATENT DOCUMENTS

| | | | |
|---|---|---|---|
| 3,614,738 | 10/1971 | Slavin | 340/163 |
| 3,746,957 | 7/1973 | Forster et al. | 318/696 |
| 3,747,524 | 7/1973 | Crum | 101/365 |
| 3,774,536 | 11/1973 | Raymond | 101/207 |
| 3,792,659 | 2/1974 | Albrecht | 101/365 |
| 3,835,777 | 9/1974 | Krgeris | 101/350 |
| 4,193,345 | 3/1980 | Schoneberger et al. | 101/365 |
| 4,213,390 | 7/1980 | Liebert et al. | 101/365 |

FOREIGN PATENT DOCUMENTS

| | | | |
|---|---|---|---|
| 2024457 | 1/1980 | United Kingdom | 101/365 |

*Primary Examiner*—J. Reed Fisher

*Attorney, Agent, or Firm*—Michael J. Striker

[57] ABSTRACT

A control device for remote adjustments of ink zones in a printing press includes a control system comprising program request control connected respectively to multiplexers provided at the input side of the control system and to multiplexers provided at the output side of the control system, and a single motor control system. The multiplexers are connected to an adjustment system activating ink knife support elements. The control device further includes a differential former interconnected between the program control request and the multiplexers at the input side of the control system, and a computer interconnected between the differential former and the single motor control unit. The motor control unit controls the adjustment system so that the unsteady course of the positions of the ink knife support elements is balanced to the steady function of the knife bending curve.

20 Claims, 3 Drawing Figures

CONTROL DEVICE FOR REMOTE ADJUSTMENTS OF INK ZONES IN PRINTING PRESSES

BACKGROUND OF THE INVENTION

The invention relates to a control device for remote adjustments of ink zones of ink dosage devices in printing presses.

Ink dosaging devices consist on an ink box with an ink knife on which adjustment systems act consisting of an adjustment drive and adjustment measuring indicator.

Ink dosaging devices are known (U.S. Pat. No. 3,835,777) which consist of a control system operating in the adjustment process for balancing the unsteady process of the position of the ink knife support elements to the steady function of the ink knife bending curve when exceeding advanced limit values. The balancing is carried out by motor control units and an adjustment system consisting of an adjustment drive and an adjustment measuring indicator which act on the ink support elements.

At the input side and the output side the control system is provided with multiplexers.

SUMMARY OF THE INVENTION

The object of the invention is to provide a control device for the remote adjustment of ink zones in printing presses with simple technical means.

It is a further object of the invention to provide a control device for the remote adjustment for ink zones in printing presses which with simple technical means provide in a single operation a balancing of the unsteady process of the position of the ink knife supporting elements to the steady function of the ink knife bending curve when exceeding advanced limit values.

In accordance with the invention this and other objects are obtained in that a single motor control unit is provided for the control system, a program request control is provided for the motor control unit and the control system at the input and output side in correct sequence, and a computer coupled with a differential former which is switched in front of the motor control unit at the output side of the motor control unit and at the input and output side with the program request control.

The control system contains a comparator which compares the fed nominal value with the measuring dimensions returned by the position measuring indicator or a comparator which compares the fed nominal value with the adjustment dimension executed by the adjustment device.

The differential former is a series circuit of a first differential amplifier coupled with the input multiplexer, with a memory coupled with the program request control and the computer and an amount former. The computer is a multiple parallel switched series circuit coupled with the coefficient potentiometer which is coupled with the first memory and an operating amplifier, or a parallel circuit of a plurality of second differential amplifiers whose first inputs are coupled through coefficient potentiometer with the output of the first memory, whose second inputs are coupled through second memory and whose third inputs are directly coupled with the second input-multiplexer.

The motor control unit consists of the series circuit of a multiplexer which is switched after the first computer and the program request control, an A/D converter, a first comparator containing a presignal memory and coupled at the input side and the output side with the output of a first motor pulse transmitter, and at the output side with the first AND-gate which is disposed in front of the output multiplexer and is coupled with the output side of the first motor pulse transmitter. The first comparator is a forward and backward counter. In accordance with another embodiment of the invention the motor control unit consists of the series circuit of a multiplexer which is disposed after the second computer and the program request control, a second comparator containing a presignal memory and coupled at the output side with a first motor pulse transmitter and the program request control, and a first AND-gate which on the input side is coupled with the first motor pulse transmitter and at the output side with the output multiplexer.

The second comparator is a zero indicator. The program request control contains a first encoder with a prepositioned counter coupled with the first input multiplexer, a second encoder with prepositioned slide register coupled with the multiplexer and a third encoder which is coupled with the output multiplexer after the slide register and the counter.

The motor control unit is coupled with an input and output unit.

The input and output unit which is coupled to the output side of the A/D converter through the input line and with the program request control is correlated to the output of the A/D converter. The input and output unit is a cassette magnetic tape. The program request control is coupled for control with the differential former and for activating with the trigger unit or the input and output unit. The input multiplexer and the multiplexer are disposed as analog switches, preferably field effective transistor switches.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
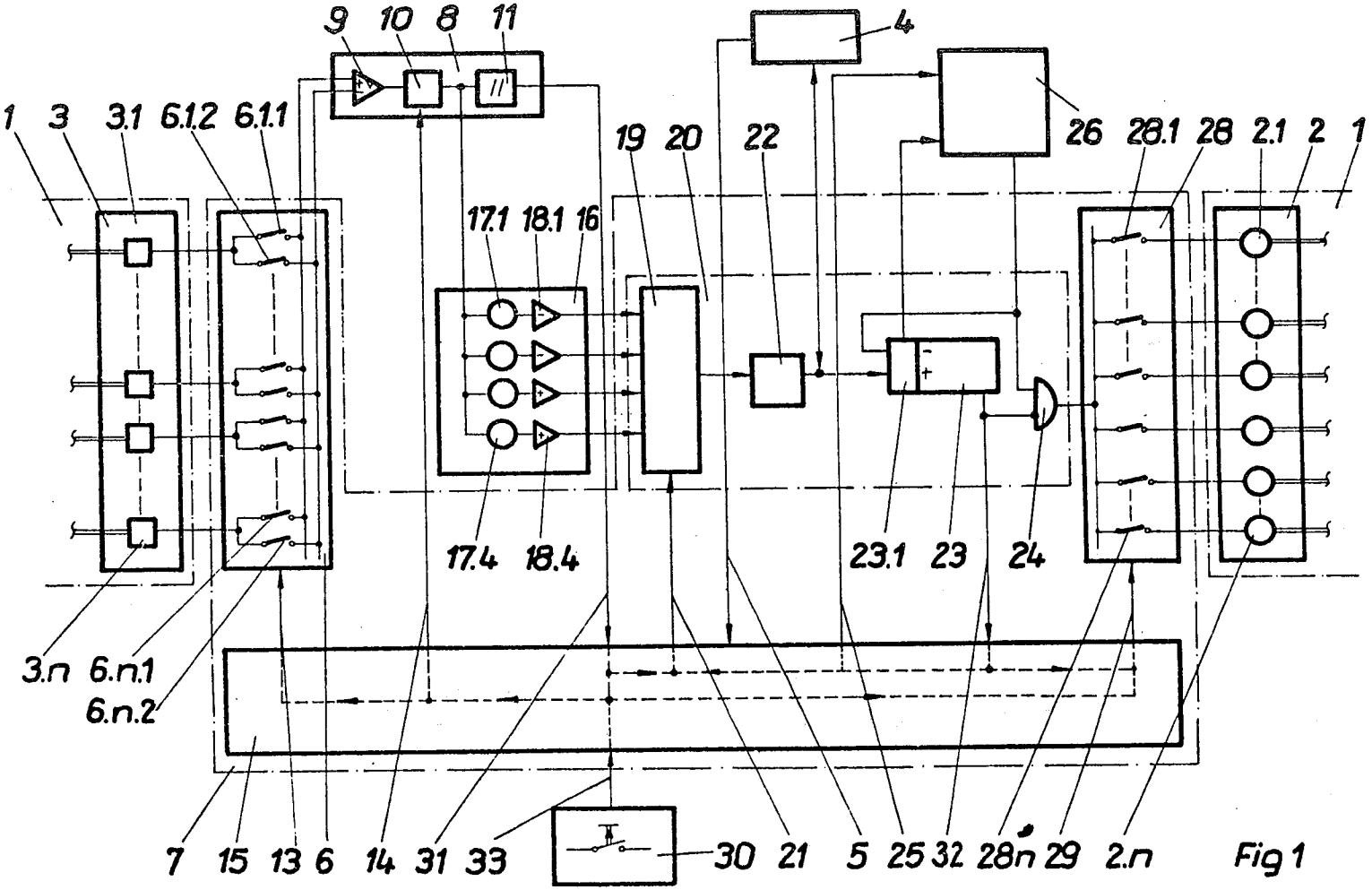
FIG. 1 is a diagrammatic view of a control device for remote adjustment of ink zones with a comparator of nominal value and adjustment dimension.

FIG. 1 shows a control device for remote adjustment of ink zones with comparator and adjustment dimensions. The device serves to adjust adjustment system 1 and consists of an adjustment drive 2, for example, electro motors 2.1 . . . 2.n. and adjustment measuring indicator 3, for example, potenetiometers 3.1 . . . 3.n. The electromotors 2.1 . . . 2.n and the potentiometers 3.1 . . . 3.n are mechanically coupled with each other.

The potentiometers 3.1 . . . 3.n are coupled through two outputs of a first input multiplexer 6 of a first control system 7 with a differential former 8 which contains a series circuit of a first differential amplifier 9, a memory 10 and an amount former 11. The contacts, 6.1.1, 6.1.2 . . . 6.n.1, 6.n.2 of the first input of the first input multiplexer 6 are controlled by command A through a first line 13., the first memory 10 of the differential former 8 is controlled by command B through a second line 14 of the program request control 15. The output of the first memory 10 leads to a first computer 16 with coefficient potentiometers 17.1 . . . 17.4 and operating amplifiers 18.1 . . . 18.4. The outputs of the operational amplifiers 18.1 . . . 18.4 of the first computer are coupled with a multiplexer 19 by a command C through a third line 21 of the program request control 15, whereby the multiplexer is associated with a first motor control unit 20 of a first control system. The output signals of the multiplexer 19 are fed through an A/D converter 22 to a first comparator 23 for nominal value and adjustment dimension. The first comparator 23 is a forward and backward center with presignal memory 23.1. The output of the first comparator 23 leads to a first AND-gate 24, whose second input is coupled with the first motor pulse indicator 26 which is controlled by the program request control 15 and by the presignal memory 23.1 and the command D through a fourth line 25. The output of the first AND-gate 24 is switched through the contacts 28.1 . . . 28.n of the output multiplexers 26 to the electro-motors 2.1 . . . 2.n of adjustment drive 1 associated with adjustment system 1 corresponding to command E through a fifth line 29.

The program request control 15 receives with command H through the sixth line 33 input commands from a manually actuated triggering unit 30 with command F through the seventh line 31 from amount former 11 and from command G through the eights line 32 from the first comparator 23.

An output unit 4 is provided for the output of the A/D converter 22 in form of a cassette magnetic tape and is coupled on the outside with the program request control 15 via line 5.

Figure 2:
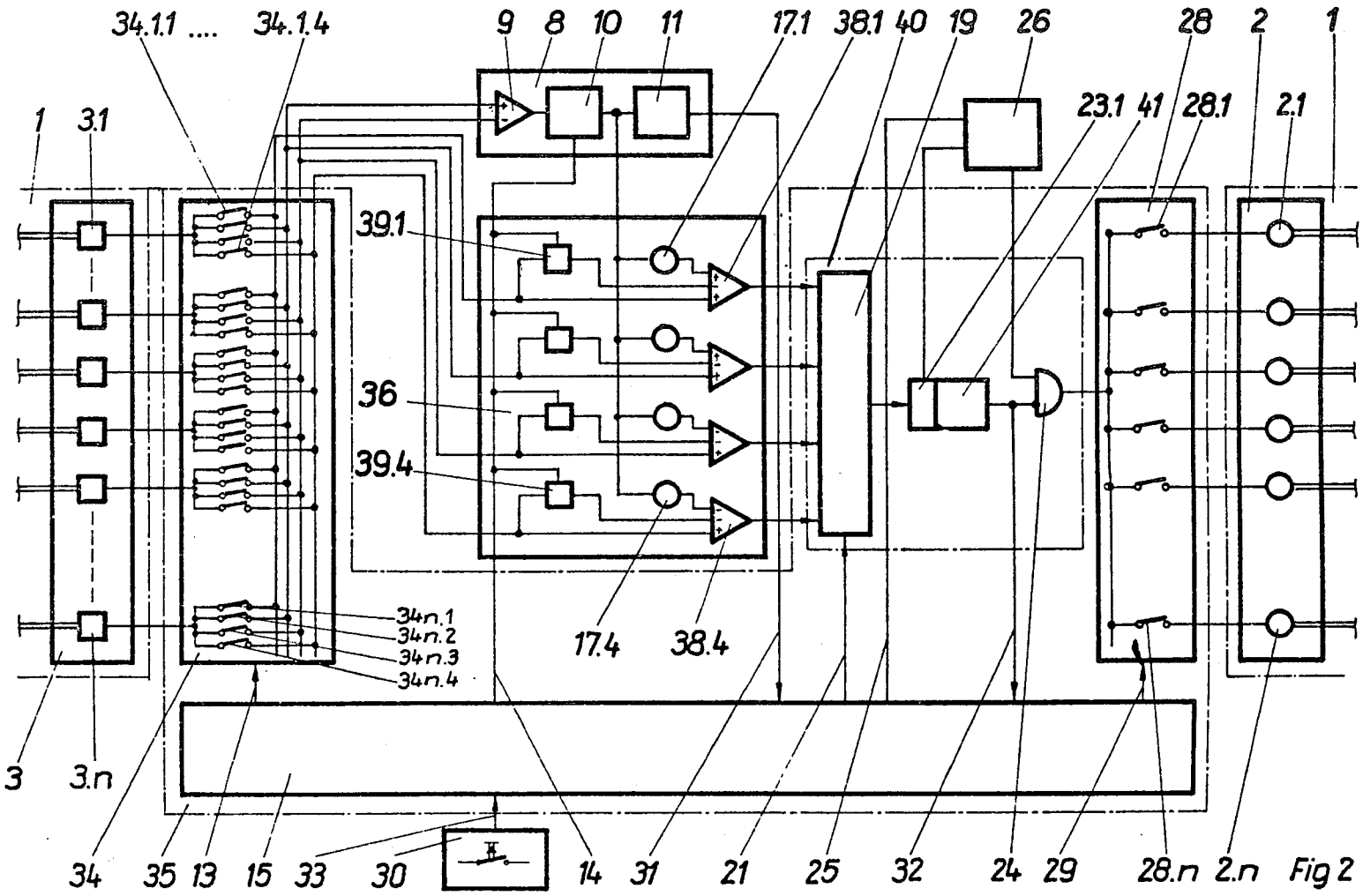
FIG. 2 is a diagrammatic view of a control device for remote adjustments for ink zones with comparator of nominal value and measuring dimension.

FIG. 2 shows a control device for remote adjustment of ink zones with a comparator of nominal value and measuring dimension. The device serves for adjusting the adjustment system 1 which consists of an adjustment drive 2, for example, electro-motors 2.1 . . . 2.n and adjustment measuring indicator 3, for example, potentiometers 3.1 . . . 3.n.

Electro-motors 2.1 . . . 2.n and potentiometers 3.1 . . . 3.n are mechanically coupled with each other. The potentiometers 3.1 . . . 3.n are coupled through two of the four outputs of the second input multiplexers 34 of the two control systems 35 with the differential former 8 described in FIG. 1 and through all four outputs of the second input multiplexer 34 with the second computer 36.

The contacts 34.1.1, 34.1.2, 34.1.3, 34.1.4 . . . 34.n.1, 34.n.3, 34.n.4 of the second input multiplexer 34 are controlled by command A through the first line 13 of the program request control 15. The second computer contains second differential amplifiers 38.1 . . . 38.4 with preswitched coefficient potentiometers 17.1 . . . 17.4 and second memory 39.1 . . . 39.4. The second memory 39.1 . . . 39.4 of the second computer 36 are controlled like the first memory 10 of the differential former 8 from command B through the second line 14 of the program request control 15. The outputs of the differential amplifiers 38.1 . . . 38.4 of the second computer 36 are coupled with a command C through the third line 21 of the program request control 15 controlling multiplexer 19 which belongs to the second motor control unit 40 of the second control system 35.

The output signals of the multiplexer 19 are fed to a second comparator 41 for nominal value and adjusted dimension. The second comparator 41 is a zero indicator with a presignal memory 23.1. The output of the second comparators 41 leads, as already shown in FIG. 1, through the first AND-gate 24 and the output multiplexer 28 to the adjustment drive 2 of adjustment system 1. The connection of the second input of the second input of the first AND-gate 24 was already described in conjunction with FIG. 1. The program request control 15 receives input commands through command H through a sixth line 33 from the manually actuated trigger unit 30 with the command F through the sixth line 31 from amount former 11 and with command G through the eights line 32 from second comparator 41.

Figure 3:
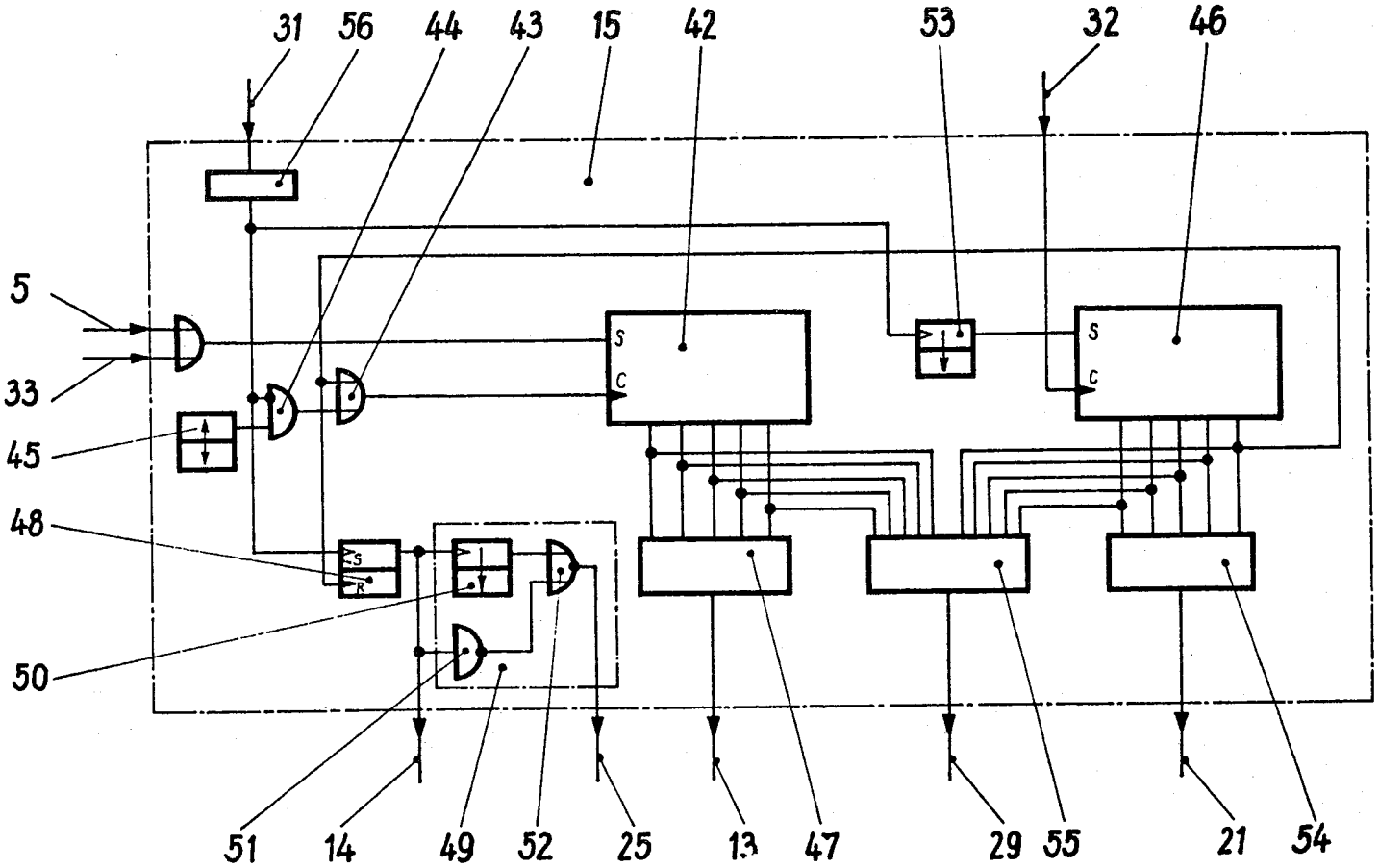
FIG. 3 is a diagrammatic view of a program request control.

FIG. 3 shows the program request control 15. This control is started by the command H through the sixth line 33 and counter 42. The counter is provided with backward inputs which are coupled on the one hand through an OR-gate 43 and with a second AND gate 44 which is controlled by a limit value member 56, whereby the AND-gate is coupled with an astable multivibrator 45, and on the other hand with an output of the slide register 46. The limit value member 56 is coupled with the output of the differential from the command F of the seventh line.

The outputs of the counter 42 deliver command A through the first encoder 47 through line 13. One output of the slide register 46 is coupled with the reset of the bistable multivibrator 48 whose set input also leads to the limit value member 56.

The output of the bistable multivibrator 48 forms the command B through the second line 14 and the input signal for a delay member 49 whose output provides the command D through the fourth line 25. The delay member 49 consists of first monostable multivibrator 50, a negator 51 and a NOR-gate 52. The set input of the slide register 46 is coupled with the limit value member 56 through a second monostable multivibrator 53.

The reset of the slide register 46 receives the command G through the eights line 32. The outputs of the slide register 46 deliver the command C through the second encoder 54 through the third line 21 and together with the outputs of counter 42 through a third encoder 55 the command E through the fifth line 29.

The mode of operation of the control device for remote adjusted ink zones with a comparator of a nominal value and adjustment dimension is explained in conjunction with FIG. 1.

The contacts 6.1.1 . . . 6.n.2 of the first input multiplexer 6 which are started belonging to the first control system 7 which is started with the command H of the manually actuated trigger unit 30 through command A the measuring values of two adjacent potentiometers 3.1 . . . 3.n in accordance with the control, of the adjustment measuring indicator 3 of adjustment system 1 with the first differential amplifier 9 of differential former 8. For example, the two measuring voltages of the two adjacent potentiometers 3.3 and 3.4 are in contact on the first differential amplifier 9 through contacts 6.3.1 and 6.4.2. At the output of the first differential amplifier 9 the differential voltage of both measuring values is available and is stored with the command B in a first memory 10 which is designed as a commonly known sample and hold circuit. The amount of the differential voltage is applied at the output of the amount former 11 and as a command F on the program request control 15. The amount former 11 may be constructed in a known manner with the assistance of operational amplifiers. The amount is required for determining limit value excess in the program request control 15.

The nominal value for the balance of the unsteady process of the positions of the ink knife supporting elements to the steady functions of the knife curve line is calculated from the differential voltage applied at the output of the first memory 10 in the first computer 16 with the assistance of an analog calculation circuit consisting of coefficient potentiometers 17.1 to 17.4 and subsequent first operational amplifiers 18.1 to 18.4 for a plurality of the adjustment systems 1 which are coupled on both sides. In the subject case, the calculation of four nominal values of the four associated adjustment systems are shown in FIG. 1. These nominal values are fed from the multiplexer 19 of the first motor control unit 20 through an A/D converter to the first comparator 23. With the assistance of the multiplexer 19 which is controlled by the program request control 15 through command C the single first motor control unit 20 is associated with the plurality of adjustment systems 1 at the input and the output side.

The first comparator 23 is a forward and backward counter with presignal memory 23.1. The first comparator 23 is set by the A/D converter and is then counted backward to zero with the pulses of the motor pulse indicator 26. At zero the command G is generated which assists the first AND-gate 24 for further pulses of the motor pulse indicator 26 and influences the program request control 15. Since the pulses of the motor pulse indicator correspond to the adjusted value, a comparison of the nominal value to the adjusted value occurs in the first comparator 23. The motor pulse indicator 26 is controlled by command D of the program request control 15, whereby the presignal memory 23.1 defines the rotational direction.

The output multiplexer 28 which is controlled by the program request control by means of command E through contacts 28.1 . . . 28.n with the electro-motors 2.1 . . . 2.n of adjustment drive 2 associated with adjustment system 1. In the exemplified case the output multiplexer 28 associates the output of the first motor control unit to the electro motors 2.2. to 2.5 until applying command G through contacts 28.2 to 28.5.

The mode of operation of the control device for remote adjustment for ink zones with a comparator of nominal value and measuring dimensions is explained in conjunction with FIG. 2. The contacts 34.1.1 . . . 34.n.4 of the second input multiplexer 34 which are controlled by command H of the manually actuated trigger unit 30 which is controlled by the second control system 35 couple the measuring values of a plurality of adjacent potentiometers 3.1 . . . 3.n with the second computer 36 corresponding to the control by command A, as well as the two median measuring values with the differential former 8 described in conjunction with FIG. 1. The second computer 36 contains a series of evenly structural analog calculating circuits consisting of second operational amplifiers 38.1 . . . 38.4 which receives on the input side the nominal value through coefficient potentiometer 17.1 . . . 17.4 and second, preferably, sample and hold circuits controlled memories 39.1 to 39.4 which are controlled by command B and the actual value from the second input multiplexer 34 to 39.4. Thereby, a presignal differential voltage between the nominal value and the measuring dimension is applied at the output of the second operational amplifier 38.1 . . . 38.4, whereby a differential voltage zero corresponds to the same value of the nominal value and measuring dimension. It serves the balance of the unsteady course of the positions of the ink knife support elements to the steady function of the knife bending curve.

This differential voltage is fed through the multiplexer 19 to the second motor control unit 40, to a second comparator 41 which is designed as a zero indicator with a presignal memory 23.1. With the assistance of the multiplexer 19 which is controlled by the program request control 15 by command C through second motor control unit 40 is associated at the input and the output side to the plurality of adjustment systems 1.

The zero indicator of the second comparator 41 delivers command G at the differential voltage zero and arrests the first AND-gate 24 from further pulses of the motor pulse indicator 26 and influences the program request control 15. The further mode of operation corresponds to the description of FIG. 1.

By changing the first computer 16 or the second computer 36 nonlinear balances may be obtained, whereby the number of support locations may be increased due to corresponding expansions.

Advantageously, the multiplexers are designed as analog switches with field effect transistor switches.

The described circuits may also be constructed with digital circuits, with the advantage to use digital counters.

FIG. 3 serves to explain the mode of operation of the program request control 15. It is controlled by command H which sets the counter 42. Thereafter, the first encoder 47, which is switched after counter 42, delivers command A for the input multiplexer, so that an analog signal is applied in command F on limit value member 56. The limit value member 56 is designed as a known Schmitt-trigger.

When no limit value excess is present a pulse of the astable multi vibrator 45 is fed through the second AND-gate 44 and the OR-gate 43 to counter 42 and effects a further switching, so that finally the sensing of the adjustment value indicator is continued with command A.

If a limit value excess is present, the bistable multivibrator 48 is set which generates command H which sets the delay member 49 which generates a delayed command D and is then arrested by the slide register 46 through the second monostable multivibrator 53.

The slide register 46 together with its outputs feeds the second encoder 54 for forming command C and together with the counter 42 the third encoder 55 for forming command E. Thereby, the single motor control unit is fed on the input side and the output side in the correct sequence to the adjustment systems. The slide register 46 is moved further by command G, that is, the described feeding is continued. A final signal is generated on the output of the slide register 46 which further switches counter 42 through the OR-gate 43.

We claim:

1. In a control device for remote adjustments of ink zones in printing presses of the type having a control system, an adjustment device cooperating with an ink knife and a position measuring indicator cooperating with ink knife support elements for balancing the unsteady course of the positions of the ink knife support elements to the steady function of the knife bending curve, the improvement wherein the control system includes a plurality of multiplexers at the input and output sides thereof connected, respectively, with said adjustment device, a single motor control unit, and a program request control arranged with the multiplexers at the input side of the motor control system, said single motor control unit and the multiplexers at the output side of the control system one after another in sequence, the device further including a differential former and a computer, said differential former being interconnected between the multiplexers at the input side of said control system and said program request control, and said computer being interconnected between said differential former and said single motor control unit.

2. Control device in accordance with claim 1, wherein the control unit contains a comparator which compares the fed nominal value with the measuring dimension returned by the position measuring indicator, said comparator being connected to said program request control.

3. Control device in accordance with claim 1, wherein the control unit contains a comparator which compares the fed nominal value with the adjustment dimension executed by the adjustment device.

4. Control device in accordance with claim 1, wherein the differential former is a series circuit including a first differential amplifier connected with the multiplexers at said input side, a memory connected with the program request control and with the computer, and an amount former (11).

5. Control device in accordance with claim 4, wherein the computer is a multiple parallel switched series circuit including coefficient potentiometer which is connected with said memory, and an operating amplifier connected to said potentiometer.

6. Control device in accordance with claim 4, wherein the computer comprises a parallel circuit including a memory, a plurality of differential amplifiers having inputs connected to said memory, a plurality of coefficient potentiometers connected to the further inputs of said amplifiers, said potentiometers being further connected with the output of the memory of said differential former, said amplifiers having still further inputs connected directly to the multiplexers at said input side.

7. Control device in accordance with claim 1, further including a motor pulse indicator connected to said single motor control unit and to said program request control.

8. Control device in accordance with claim 7, wherein said single motor control unit includes arranged in a series circuit a multiplexer, an analog-to-digital converter, a comparator having a presignal memory and an AND-gate, said multiplexer being connected to said computer, said AND-gate having an input connected to said program request control and an output connected to the multiplexers at said output side of the control system, said presignal memory being connected to said motor pulse indicator.

9. Control device in accordance with claim 8, said presignal memory having an output side connected to said motor pulse indicator, said AND-gate being also connected to said motor pulse indicator.

10. Control device in accordance with claim 9, wherein the comparator of the single motor control unit is a zero indicator.

11. Control device in accordance with claim 8, said presignal memory having an input side which is connected to said motor pulse indicator and an output side which is also connected to said motor pulse indicator and to said AND-gate, said AND-gate being also connected to said motor pulse indicator.

12. Control device in accordance with claim 8, further including an input and output unit connected to said program request control, said single motor control unit being connected to said input and output unit.

13. Control device in accordance with claim 12, wherein said program request control is activated by said input and output unit.

14. Control device in accordance with claim 12, wherein said input and output unit is connected to an output side of said analog-to-digital converter.

15. Control device in accordance with claim 12, wherein the input and output unit is a cassette magnetic tape.

16. Control device in accordance with claim 8, wherein said multiplexers at said input side of the control system and the multiplexer of said single motor control unit are formed as analog switches.

17. Control device in accordance with claim 16, said analog switches being field effective transistor switches.

18. Control device in accordance with claim 8, wherein the comparator of said single motor control unit is a forward and backward counter.

19. Control device in accordance with claim 8, wherein the program request control includes a first encoder, a prepositioned counter connected to the multiplexers at said input side of the control system, a second encoder, a prepositioned slide register connected to the multiplexer of said single motor control unit, a third encoder connected to the multiplexers at said output side of the control system after the slide register and the counter.

20. Control device in accordance with claim 19, wherein said program request control is activated by a trigger unit.

* * * * *